United States Patent [19]

Luebke

[11] 4,380,290

[45] Apr. 19, 1983

[54] SHIPPING AND STORAGE CONTAINER

[76] Inventor: Randall A. Luebke, 311 5th St., Huntington Beach, Calif. 92648

[21] Appl. No.: 252,384

[22] Filed: Apr. 9, 1981

[51] Int. Cl.[3] ..... B65D 25/04

[52] U.S. Cl. ..... 206/315 R; 220/22.2

[58] Field of Search ..... 206/315 R, 45.16, 804; 220/22.1, 22.5, 355, 22.2

[56] References Cited

U.S. PATENT DOCUMENTS

| | | | |
|---|---|---|---|
| 2,281,251 | 4/1942 | Simmons | 206/804 X |
| 2,646,875 | 7/1953 | Feder | 206/45.16 |
| 2,695,115 | 11/1954 | Roop | 220/355 |

*Primary Examiner*—Steven M. Pollard
*Assistant Examiner*—D. Voorhees
*Attorney, Agent, or Firm*—Francis X. LoJacono

[57] ABSTRACT

A container for shipping and storing articles, particularly elongated articles such as (for example) snow skis, the container being defined by a preformed, elongated housing. Siidably disposed within the housing is an adjustable partition to provide various sizes of storage compartments, the size depending upon the length of the article being stored therein. The selective positioning of the partition will further provide a secondary storage compartment. This selective positioning is established by an elongated strap member attached to the partition and looped about the inner and outer surfaces of the housing passing through each end member, so as to be adjustably secured on the outer surface thereof, thereby securing the partition in place. The strap further defines a handle for carrying the container.

6 Claims, 6 Drawing Figures

SHIPPING AND STORAGE CONTAINER

BACKGROUND OF THE INVENTION

The present invention relates generally to a container for storing, carrying, and shipping articles. More particularly, it relates to the storing, carrying and/or shipping of elongated articles, such as skis and other associated elements.

It is well known in the art that various problems and difficulties are encountered in providing suitable means for storing, carrying and/or shipping elongated articles, particularly skis.

Many types of devices are used to carry skis and the like; but they are generally limited in use and are very often specific in design, whereby the particular device is not adaptable for other types of articles. There are few available devices that can be employed as carrying containers, as well as storage and shipping apparatuses, to provide complete protection for the stored article—even under adverse conditions.

The container herein disclosed is particularly designed to accommodate various sizes of skis; but it should be understood that there are many articles that could readily be stored within the present container, due to its unique arrangement.

The prior art indicates that several attempts have been made to provide for the storing, carrying or shipping of skis. However, these devices are restricted to ski equipment only, and they do not offer the advantages of the present invention, nor are they as versatile and adaptable. Such devices are to be found in U.S. Pat. Nos. 3,767,036 to McLeod and 3,921,871 to Heil. These devices have features that restrict their use, and they are complicated to operate and expensive to maintain.

The Heil apparatus is a complicated structure comprising three telescoping body members which must be adjusted and locked into position to fit the particular pair of skis.

The McLeod apparatus is a two-part hinged container, much like a typical suitcase, having rigid masses mounted therein to receive the ski equipment.

SUMMARY AND OBJECTS OF THE INVENTION

The present invention provides a container that overcomes the various problems relating to storing, carrying and shipping elongated articles—particularly snow skis and related equipment. The container comprises a tubular housing having ends which are closed off, preferably by removable cap members. Within the housing is an adjustable partition positionally disposed by means of a strap connected to the partition, the strap being looped about the wall surface of the housing and passing out through each closed end.

It is, therefore, an object of the invention to provide a container of this character that is adapted to receive articles of various lengths, the positioning of the partition being regulated to accommodate the particular article stored therein.

Another object of the invention is to provide a shipping and storage container of this type that will include a secondary compartment, if needed, for additional equipment storage.

It is a further object of the present invention to provide such a novel container having relatively few operating parts, wherein the positioning of the inner partition determines the size of the principle storage compartment.

Still another object of the invention is to provide a shipping and storage container that can be readily hand-carried by means of the same strap that allows for the adjustment of the movable partition.

It is still another object of the invention to provide a container as described, wherein access thereto can be made through either or both of the open ends of the housing.

A still further object of the present invention is to provide a device of this character that is relatively inexpensive to manufacture, and that is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
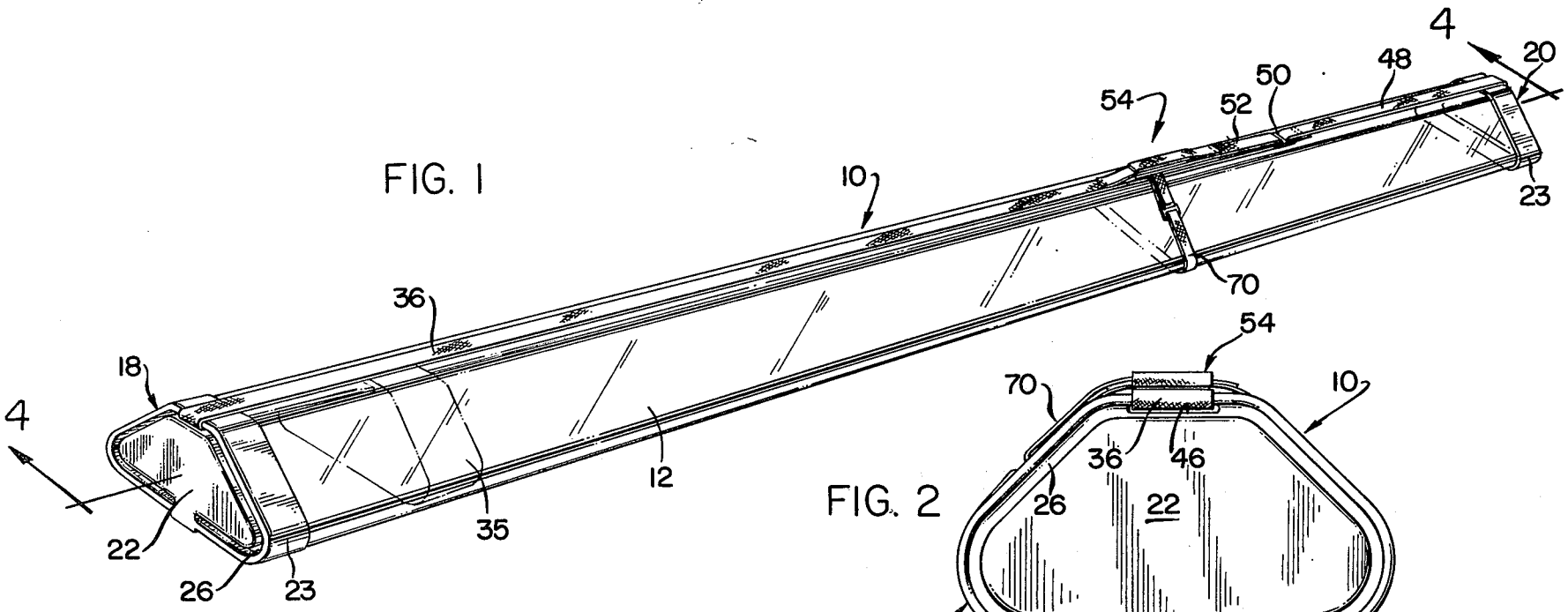
FIG. 1 is a perspective view of the shipping and storage container.
Figure 2:
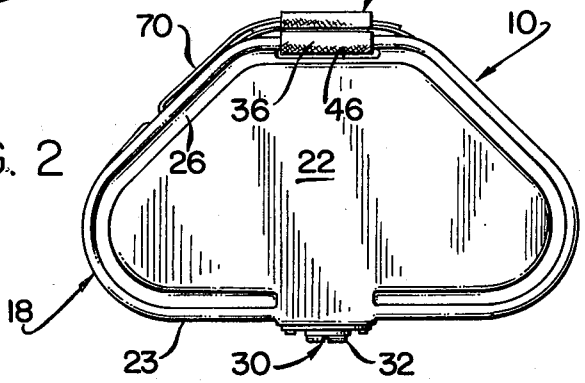
FIG. 2 is an elevational view of one end thereof.

Referring to the drawings and more particularly to FIGS. 1 through 6, there is disclosed a shipping and storage container, generally indicated at 10, comprising an elongated, monolithic, tubular housing 12. The housing 12 can be formed from any suitable material that can withstand severe abuse; however, the preferred material is a plastic whereby the housing may be formed by an extrusion method (or any other suitable forming method) that allows it to be shaped into various cross-sectional configurations, each defining an elongated hollow structure.

Thus, housing 12 includes oppositely disposed access ends 14 and 16. Each open end is adapted to receive a closure means defined by removable cap members, designated at 18 and 20, respectively. Each cap member is formed having a closure wall 22 that includes an outwardly projecting peripheral flange 23 which overlaps the outer surface of the housing wall 24. A peripheral groove 25 is defined by flange 23, and an adjacent rib 26 which is formed in wall 22. The grooves 25 are shaped to receive the free edges of the open ends of housing 12. This arrangement of cap members 18 and 20, and grooves 25, defined as above, establishes a means to structurally support the open ends, whereby the ends are prevented from collapsing during shipping or storing of the container.

Figure 4:
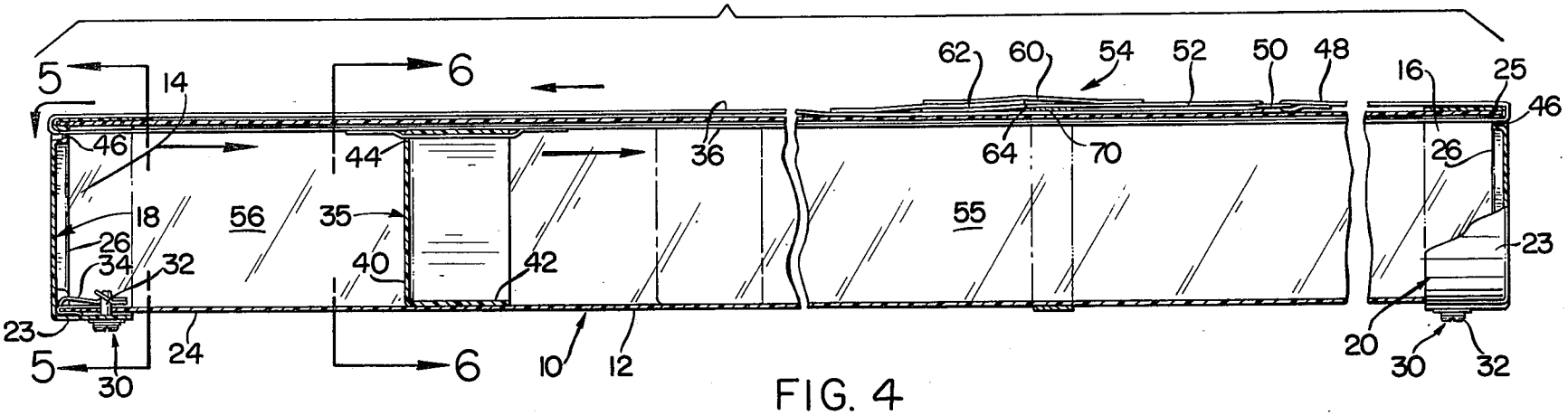
FIG. 4 is an enlarged, longitudinal, cross-sectional view taken substantially along line 4—4 of FIG. 1.
Figure 6:
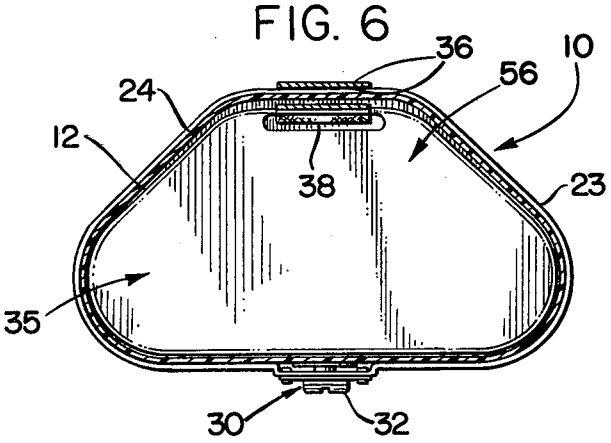
FIG. 6 is an enlarged, transverse, cross-sectional view taken substantially along line 6—6 of FIG. 4, showing the relationship between the container housing and the movable partition.
Figure 5:
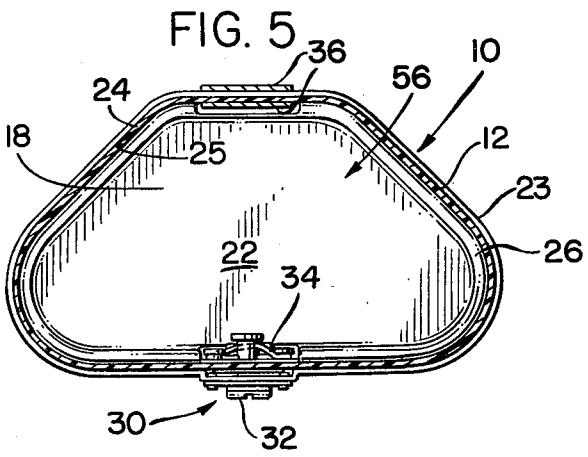
FIG. 5 is an enlarged, transverse, cross-sectional view taken substantially along line 5—5 of FIG. 4, showing one of the capped ends of the container.

Accordingly, in order to prevent the cap members 18 and 20 from being dislodged from housing 12, a suitable locking means is provided, such as generally indicated at 30, the locking means being shown comprising a rotatable hook pin 32 which is releasably secured to keeper 34 attached to the inner surface of the housing wall 24, as illustrated in FIGS. 4 and 5.

Thus, to establish a compartment that is adjustable in size—in other words, adjustable to the particular length of a given article—there is provided a means to selectively position a movable partition 35 within the tubular housing. If one desires to store, ship or carry a pair of skis in the container 10, the skis would be inserted through one of the open ends—preferably end 16—at which time partition 35 is adjusted to a position whereby the skis would be firmly held in place between partition 35 and end-cap member 20, after cap 20 is locked in place.

The means for selectively positioning partition 35 comprises an elongated strap 36 which is looped about the inner and outer surfaces of wall 24 of housing 12, as seen in FIGS. 1 and 4. Strap 36 is attached to partition 35. The attaching of strap 36 to partition 35 can be performed in any suitable manner, but it is herein shown as being attached by a strip of material 38 similar to that of strap 36. Partition 35 comprises a flat wall 40 transversely positioned in housing 12, and held in that relative position by a peripheral-guide flange 42. Partition 35 is so formed as to allow strap 36 to pass between its peripheral-guide flange and wall 24 of the housing 12. Strip 38 is received in slot 44 formed in partition 35, and secured at both ends to strap 36. Thus, any longitudinal movement, back and forth, of strap 36 along the length of housing 12 will, in turn, move partition 35.

Each end-cap member 18 and 20 is provided with a slot 46 which allows strap 36 to extend outwardly from tubular housing 12, so as to be looped about wall 24. Thus, any longitudinal movement of strap 36 will cause partition 35 to move within housing 12. One end 48 of strap 36 is provided with a buckle 50 which is adapted to receive the opposite free end 52 which includes a securing means, generally indicated at 54. After partition 35 is adjusted in position within housing 12, means 54 is secured to prevent any further movement of strap 36 and partition 35.

Accordingly, when a pair of skis are to be stored therein, the strap is moved longitudinally until partition 36 is pressed against the particular-size skis, whereby the skis would be held in place between partition 36 and end-cap member 20. Thus, a first storage compartment 55 is defined therebetween; and a second smaller compartment 56 is defined between partition 35 and end-cap member 18. The second compartment 56 provides an additional storage area, when other equipment is to be stored with the principle article. For example, if skis are to be stored in the first compartment 55, gloves, shoes, etc., can be stored in the second compartment 56—so that all desired articles can be shipped and carried together.

Securing means 54 can be provided by any suitable devices, such as hooks, clamps, snap buttons, etc. However, the preferred device is shown as comprising a plurality of securing bands 60, 62 and 64. Securing band 60 is attached to free end 52 having "Velcro" (trademark) material mounted thereto, so as to be secured to the mating "Velcro" material mounted to band 62 which is secured along strap 36—whereby band 60 overlaps band 62, and band 62 overlaps band 64, which is defined by the terminating end of strap 36.

Figure 3:
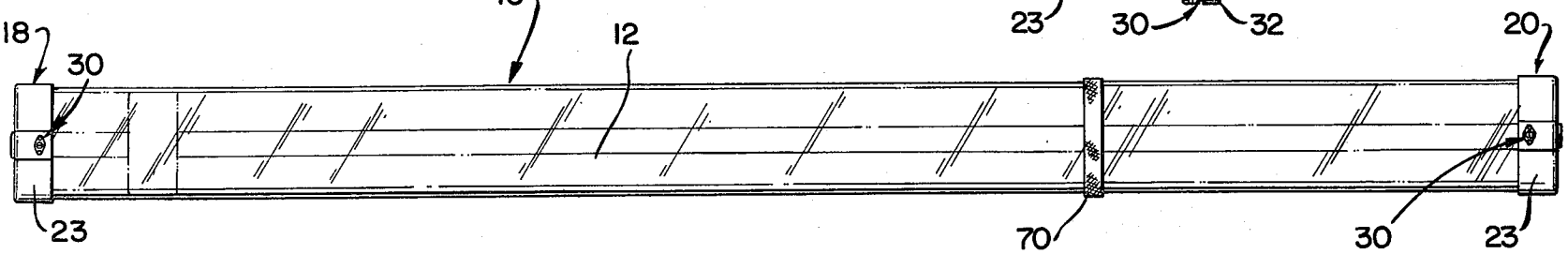
FIG. 3 is a bottom-plan view thereof.

There is also provided a transverse strap member 70 which wraps around housing 12, as seen in FIGS. 1 and 3. This band also includes a fastening means, with preferably "Velcro", wherein it is secured to strap 36 to prevent lateral movement of strap 36. It is well known that "Velcro" is a trademark for a material comprising male and female, flexible, connecting sheets which, when placed in contact with each other, releasably lock together.

Hence, it should be noted that other arrangements of the elongated housing are contemplated which would incorporate a compartment adapted to accommodate a movable partition having the disclosed selective positioning means. Thus, housing 12 could be formed by two hinged half sections which would define an elongated closed-end compartment, the adjustable partition being adapted to be slidable received in the compartment.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example; and I do not wise to be restricted to the specific form shown or uses mentioned, except as defined in the accompanying claims.

I claim:

1. A shipping, storing and carrying container comprising:

an elongated, monolithic, tubular housing having oppositely disposed open ends;

a pair of cap members adapted to be removably mounted to said housing, to cover each of said open ends thereof;

a releasable locking means positioned between said cap members and said housing, to lock said cap members to said housing;

a slidably adjustable partition positioned within said housing;

a first and second chamber in said housing defined by said partition;

means for adjusting said partition to a selected position within said tubular housing;

means for securing said partition in said selected position;

each of said cap members comprising:

a closure wall having an outwardly projecting peripheral flange member;

a peripheral rib formed in said closure wall adjacent said peripheral-flange member, thereby defining a peripheral groove adapted to receive said open end of said housing therein; and a slot disposed in said closure wall, to allow said adjusting means of said partition to extend outwardly from said housing;

wherein said adjustable means of said partition comprises an elongated longitudinal strap member attached to said partition, wherein the ends of said strap member are passed through said slots in said cap members, and are adapted to be secured to each other on the outer surface of said housing, after said partition is arranged in a selected position, and wherein said securing means is mounted to said strap member.

2. A container as recited in claim 1, wherein one end of said strap member includes a buckle, and wherein said other end thereof is formed having said securing means mounted thereto.

3. A container as recited in claim 2, wherein said securing means comprises a plurality of securing bands arranged to be interconnected to each other, to establish a continuous strap support defining a carrying handle.

4. A container as recited in claim 2, wherein said securing means comprises a plurality of securing bands including mating male and female, flexible, connecting sheets which, when placed in engaging contact with each other, releasably lock together.

5. A container as recited in claim 4, wherein said securing means includes a transverse strap member connectable to said longitudinal strap member attached thereto, and prevented from lateral movement about said housing.

6. A shipping, storing and carrying container comprising:

an elongated housing defining an enclosed compartment having closed ends;

a slidably adjustable partition positioned within said enclosed compartment;

means for adjusting said partition to a selected position within said compartment;

wherein said adjustable means of said partition comprises an elongated longitudinal strap member attached to said partition, wherein the ends of said strap member extend outwardly from said compartment and are adapted to be secured on the outer side of said housing, after said partition is adjusted to a selected position, and wherein said securing means is mounted to said strap member;

means for securing said partition in said selected position remotely from said partition;

wherein said securing means comprises a plurality of securing bands arranged to be interconnected to each other, to establish a continuous strap support defining a carrying handle.

* * * * *